US006989350B2

(12) United States Patent
Hirota et al.

(10) Patent No.: US 6,989,350 B2
(45) Date of Patent: Jan. 24, 2006

(54) PROTECTIVE LAYER THERMAL TRANSFER SHEET AND MATTED PRINT

(75) Inventors: Kenichi Hirota, Shinjuku-ku (JP); Daisuke Fukui, Shinjuku-ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 195 days.

(21) Appl. No.: 10/627,965

(22) Filed: Jul. 28, 2003

(65) Prior Publication Data

US 2005/0090394 A1 Apr. 28, 2005

(30) Foreign Application Priority Data

Jul. 29, 2002 (JP) ..... 2002-219377
Jul. 15, 2003 (JP) ..... 2003-197346

(51) Int. Cl.
*B41M 5/035* (2006.01)
*B41M 5/38* (2006.01)

(52) U.S. Cl. ..... 503/227; 428/32.77; 428/32.78; 428/32.79; 428/32.81

(58) Field of Classification Search ..... 428/32, 428/81, 195.1
See application file for complete search history.

(56) References Cited

U.S. PATENT DOCUMENTS 5,427,997 A 6/1995 Oshima et al. ..... 503/227
6,114,027 A * 9/2000 Onishi et al. ..... 428/323
6,413,687 B1 7/2002 Hattori et al. ..... 430/10

FOREIGN PATENT DOCUMENTS

EP 1 179 753 A1 2/2002

* cited by examiner

*Primary Examiner*—Bruce H. Hess
(74) *Attorney, Agent, or Firm*—Oliff & Berridge, PLC

(57) ABSTRACT

There is provided a protective layer thermal transfer sheet which can impart an excellent matte tone to an image, produced by a sublimation dye thermal transfer method, without the need to additionally provide any special step and without deteriorating high definition and high sharpness of images inherent in sublimation dye transferred images. There are also provided a protective layer thermal transfer sheet for controlling the gloss of an image, and a matted print produced using the protective layer thermal transfer sheet. The protective layer thermal transfer sheet comprises a substrate sheet and, stacked on at least a part of one side of the substrate sheet in the following order, a release layer, a protective layer and optionally an adhesive layer. The release layer contains a filler and has a roughened surface.

3 Claims, 1 Drawing Sheet

PROTECTIVE LAYER THERMAL TRANSFER SHEET AND MATTED PRINT

TECHNICAL FIELD

The present invention relates to a protective layer thermal transfer sheet. More particularly, the present invention relates to a protective layer thermal transfer sheet, which can transfer a protective layer with an excellent matte tone onto an image formed by sublimation dye transfer, and a print comprising an image formed by sublimation dye transfer and a matted protective layer provided on the image.

BACKGROUND ART

At the present time, thermal transfer recording is widely used as a simple printing method. The thermal transfer recording can simply form various images and thus is utilized in printing wherein the number of prints may be relatively small, for example, in the preparation of ID cards, such as identification cards, photographs for business, or is utilized in printers of personal computers or video printers.

When a full-color gradational image such as a photograph-like image of a face is desired, the thermal transfer sheet used is such that, for example, various colorant layers of yellow, magenta, and cyan and optionally black are provided as colorant layers in a large number in a face serial manner on a continuous substrate sheet.

Such thermal transfer sheets are classified roughly into thermal transfer sheets of the so-called "thermal ink transfer" type wherein the colorant layer is melted and softened upon heating and as such is transferred onto an object, that is, an image-receiving sheet, and thermal transfer sheets of the so-called "sublimation dye transfer" type wherein, upon heating, a dye contained in the colorant layer is sublimated to permit the dye to migrate onto the image-receiving sheet.

When the above thermal transfer sheet is used, for example, for preparing identification cards or documents, the thermal ink transfer type is advantageous in that monotonous images, such as letters or numeric characters, can be easily formed. In the thermal ink transfer type, however, for example, gradation rendering of images is disadvantageously unsatisfactory.

On the other hand, in the case of the sublimation dye transfer type, gradational images, such as photograph-like images of a face, can be faithfully formed. Images formed by the sublimation dye transfer method, however, are disadvantageously poor in fastness or resistance properties such as weathering resistance, abrasion resistance, and chemical resistance, because, unlike images formed by conventional printing inks, the image is free from any vehicle and is formed of only dyes.

The following method is known as a method for solving the above problems. Specifically, a protective layer thermal transfer sheet having a transferable protective layer is put on top of an image formed by thermal transfer of a heat-fusion ink layer or a sublimable dye. The assembly is heated by means of a thermal head, a heating roll or the like to transfer the transferable protective layer to form a protective layer on the image. The provision of the protective layer can improve the abrasion resistance, chemical resistance, solvent resistance and other properties of the image to some extent. Further, the incorporation of an ultraviolet absorber or the like in the protective layer can improve the lightfastness of the image.

When a protective layer is transferred from the conventional protective layer thermal transfer sheet, a transferred protective layer constituting the outermost surface is flat and has excellent gloss. In general, however, this protective layer cannot meet a requirement for a matte tone in color photographs or other images. For example, the following methods are considered effective for meeting the requirement for a sublimation dye transferred image with a matte tone:

1) a method wherein a filler is incorporated in a dye-receptive layer in a thermal transfer image-receiving sheet to form fine concaves and convexes on the surface of the receptive layer;

2) a method wherein the surface of a sublimation dye transferred image is treated by an emboss roll or the like to form fine concaves and convexes on the surface of the image;

3) a method wherein a filler is incorporated in a protective layer; and 4) a method wherein, after the transfer of a protective layer, the surface of the protective layer is treated by an emboss roll or the like to form fine concaves and convexes on the surface of the protective layer.

In the method 1), however, the presence of the fine concaves and convexes on the surface of the receptive layer makes it difficult to form a high-definition image. In the method 2), the embossing is detrimental to the high-definition image and deteriorates the image quality. In the method 3), the transparency of the protective layer is lowered, and the sharpness of the image is lowered. In the method 4), the provision of one additional step is necessary for image formation. Further, since the sublimation dye transferred image is generally formed in a small lot, continuous processing is impossible. This incurs high cost, and, thus, the method 4) cannot be put into practical use.

Accordingly, an object of the present invention is to provide a protective layer thermal transfer sheet which can impart an excellent matte tone to an image, produced by a sublimation dye transfer method, without the need to additionally provide any special step and without deteriorating high definition and high sharpness of images inherent in sublimation dye transferred images.

DISCLOSURE OF THE INVENTION

According to one aspect of the present invention, there is provided a protective layer thermal transfer sheet comprising: a substrate sheet and, stacked on at least a part of one side of the substrate sheet in the following order, a release layer, a protective layer and optionally an adhesive layer, said release layer containing a resin and a filler and having a roughened surface.

According to another aspect of the present invention, there is provided a protective layer thermal transfer sheet for controlling the gloss of an image, comprising the above protective layer thermal transfer sheet, the content of the filler, in terms of PV ratio defined as the ratio of the solid content of the filler contained in the release layer to the solid content of a binder in the release layer, having been controlled to a value in the range of 0.05 to 0.5% by weight to control the gloss of an image, after the transfer of the protective layer from the protective layer thermal transfer sheet onto the image, to a predetermined value in the range of 0 (zero) to 50.0 as measured at an angle of incidence of 45 degrees with a glossmeter.

According to a further aspect of the present invention, there is provided a matted print comprising a sublimation dye transferred image and, provided on the surface of the image, a protective layer having in its surface fine concaves and convexes which has been transferred using the above protective layer thermal transfer sheet.

According to the present invention, at the time of the transfer of the protective layer, the protective layer is separated at the interface between the release layer and the protective layer and is transferred. In this case, since the release layer contains a suitable amount of a filler having a suitable average particle diameter, at the time of the formation of the release layer, fine concaves and convexes are formed on the surface of the release layer. When a protective layer is coated onto the surface of the release layer, fine concaves and convexes are also formed automatically on the surface of the protective layer in contact with the release layer. After the transfer of the protective layer, the fine concaves and convexes in the protective layer are located on the outermost surface of the image. Further, the regulation of the PV ratio or the content of the filler in the protective layer thermal transfer sheet in a specific value range can realize the regulation of gloss of the thermal transfer sheet to a predetermined value. Therefore, according to the present invention, an excellent matte tone can be imparted to an image, produced by a sublimation dye transfer method, without the need to additionally provide any special step and without deteriorating high definition and high sharpness of images inherent in sublimation dye transferred images.

BEST MODE FOR CARRYING OUT THE INVENTION

Figure 1:
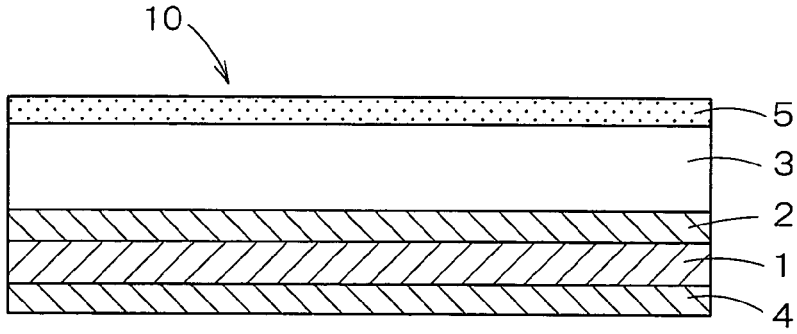
FIG. 1 is a typical cross-sectional view of an embodiment of the protective layer thermal transfer sheet according to the present invention.

The present invention will be described in more detail with reference to the following preferred embodiments. FIG. 1 is a typical enlarged cross-sectional view showing a fundamental form of a protective layer thermal transfer sheet 10 according to the present invention. A transferable protective layer 3 is provided on one side of a substrate sheet 1 through a release layer 2. A heat-resistant slip layer 4 is provided on the other side of the substrate sheet 1. Preferably, a heat-sensitive adhesive layer 5 is provided on the surface of the protective layer 3 from the viewpoint of improving the transferability of the protective layer 3.

Figure 2:
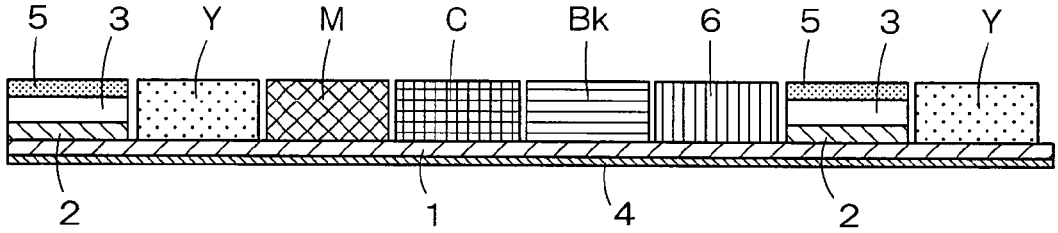
FIG. 2 is a typical cross-sectional view of another embodiment of the protective layer thermal transfer sheet according to the present invention.

FIG. 2 is a typical cross-sectional view of another embodiment of the protective layer thermal transfer sheet 10 according to the present invention. This protective layer thermal transfer sheet 10 includes a substrate sheet 1 and, provided on one side of the substrate sheet 1, a protective layer region comprising a release layer 2 and a transferable protective layer 3 as in the above first embodiment. In addition, at least one colorant layer selected from sublimable dye layers of Y (yellow), M (magenta), C (cyan), and Bk (black) and heat-fusion ink layers 6 of Y, M, C, and Bk is provided face-serially with the protective layer. The heat-resistant slip layer 4 and the heat-sensitive adhesive layer 5 are as described above in connection with FIG. 1. The use of the protective layer thermal transfer sheet in this embodiment enables the formation of a desired image on an object by using one protective layer thermal transfer sheet and one thermal printer and further can realize the transfer of a protective layer in a desired image region.

Figure 3:
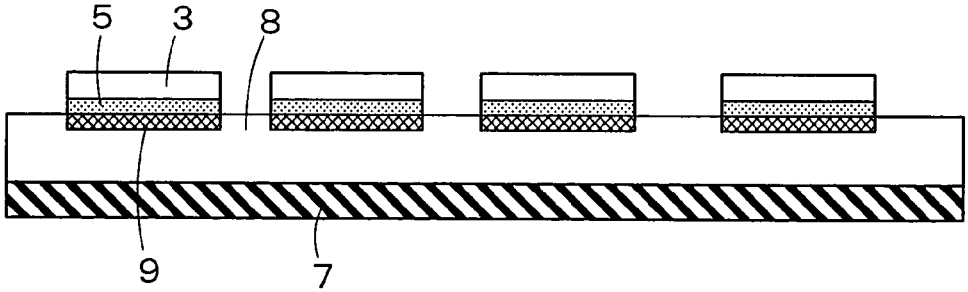
FIG. 3 is a cross-sectional view of the print according to the present invention.

FIG. 3 shows a cross-sectional view of a print. The print includes an image and a protective layer transferred on the surface of the image from the protective layer thermal transfer sheet according to the present invention. In FIG. 3, an image-receiving sheet comprises a substrate sheet 7 and a dye-receptive layer 8 provided on a surface of the substrate sheet 7. A dye image 9 is provided on the dye-receptive layer 8. A protective layer 3 has been transferred only on the surface of the dye image 9 provided on the substrate sheet 7 through an adhesive layer 5. Alternatively, the protective layer 3 may be transferred on the whole image region including other images, for example, character images formed by the transfer of a heat-fusion ink layer. Further, the image to be protected is not particularly limited to dye images formed by the sublimation dye transfer method and may be, for example, images formed by ink jet recording or electrophotographic images which are low, for example, in surface fastness or resistance properties.

Each layer constituting the protective layer thermal transfer sheet according to the present invention will be described.

(Substrate Sheet)

In the protective layer thermal transfer sheet of the present invention, any substrate sheet used in conventional thermal transfer sheets as such may be used as the substrate sheet. Further, sheets having a surface subjected to easy-adhesion treatment and other sheets may be used as the substrate sheet without particular limitation.

Specific examples of preferred substrate sheets include: films of plastics such as polyesters including polyethylene terephthalate, polycarbonates, polyamides, polyimides, cellulose acetate, polyvinylidene chloride, polyvinyl chloride, polystyrene, fluororesins, polypropylene, polyethylene, and ionomers; papers such as glassine paper, capacitor paper, and paraffin paper; and cellophanes. Further, for example, composite films formed by stacking two or more of the above materials on top of each other or one another may also be used. The thickness of the substrate sheet may be properly varied depending upon materials for the substrate sheet so that the substrate sheet has proper strength and heat resistance. In general, however, the thickness is preferably about 2.5 to 10 $\mu$m.

(Release Layer)

A release layer is provided on the substrate sheet from the viewpoint of imparting suitable transferability to a transferable protective layer provided on the substrate sheet through the release layer. Resins usable for forming the release layer may be any conventional resin having excellent releasability. Examples thereof include waxes, silicone waxes, silicone resins, silicone-modified resins, fluororesins, fluorine-modified resins, polyvinyl alcohols, acrylic resins, acrylstyrene resins, heat crosslinkable epoxy-amino resins, and heat crosslinkable alkyd-amino resins. These releasable resins may be used solely or as a mixture of two or more.

In the present invention, the release layer is characterized by comprising the above releasable resin material and a filler and having in its surface fine concaves and convexes. Fillers usable herein include, for example, conventional inorganic fillers such as silica, alumina, clay, talc, diatomaceous earth, zeolite, calcium carbonate, barium sulfate, zinc oxide, titanium oxide, and glass beads, and plastic pigments of thermosetting resins, thermoplastic resins, waxes and the like. Among the above fillers, the inorganic fillers can provide an excellent matte feeling in a smaller addition amount than the organic fillers. The above fillers may be used solely or as a mixture of a plurality of kinds of them.

In forming the release layer, the filler is preferably added in an amount of 5 to 100 parts by weight, more preferably 5 to 50 parts by weight, based on 100 parts by weight of the releasable resin. When the amount of the filler used is below the lower limit of the above-defined range, a suitable fine concave-convex shape cannot be formed on the surface of the release layer. On the other hand, when the amount of the filler used is above the upper limit of the above-defined range, the separability of the protective layer and the layer strength of the release layer are lowered. This poses a problem of the separation of the protective layer. The average particle diameter of the filler is also important and is generally 1 to 20 μm, preferably about 5 to 15 μm. When the particle diameter of the filler is below the lower limit of the above-defined range, satisfactory fine concaves and convexes cannot be provided on the surface of the protective layer. On the other hand, when the particle diameter of the filler is above the upper limit of the above-defined range, a satisfactory matte tone cannot be provided. In this case, the addition of a large amount of filler is necessary, and this makes it impossible to realize the separation at the interface between the release layer and the protective layer. The use of a mixture of a filler having a large particle diameter with a filler having a small particle diameter can provide a good balance between the peel force of the protective layer and the fine concaves and convexes of the surface thereof.

The release layer is formed from the releasable resin and the filler by dissolving the resin and the filler, together with a crosslinking agent or a catalyst, in a general-purpose solvent, such as methyl ethyl ketone, toluene, or isopropyl alcohol, to prepare a coating liquid, for example, having a solid content of about 5 to 50% by weight, coating the coating liquid onto a substrate sheet in its transferable protective layer forming region by a conventional coating method such as gravure coating or gravure reverse coating to a thickness of about 0.5 to 5 μm on a dry basis, and drying the coating.

(Transferable Protective Layer)

Any conventional resin having various excellent fastness and resistance properties and transparency may be used as the resin for transferable protective layer formation, and examples thereof include acrylic resins, cellulosic resins, polyvinyl acetal resins, and polyester resins. The transferable protective layer may be formed from the resin by dissolving or dispersing the resin in a general-purpose solvent, such as methyl ethyl ketone, toluene, or isopropyl alcohol, in a suitable ratio which will be described later, to prepare a coating liquid, for example, having a solid content of about 5 to 50% by weight, coating the coating liquid onto the surface of a release layer by a conventional coating method, such as gravure coating or gravure reverse coating, to a thickness of about 0.5 to 5 μm on a dry basis, and drying the coating.

(Heat-Sensitive Adhesive Layer)

In the present invention, when the transferable protective layer has satisfactory adhesion, the formation of the adhesive layer is unnecessary. However, the formation of a heat-sensitive adhesive layer on the surface of the transferable protective layer is preferred from the viewpoint of improving the transferability of the transferable protective layer and the adhesion between the protective layer and the surface of an image after the transfer of the protective layer onto the image. The heat-sensitive adhesive layer may be formed of any conventional heat-sensitive adhesive. Preferably, the heat-sensitive adhesive layer is formed of a thermoplastic resin having a glass transition temperature of 50 to 100° C. Preferably, a resin having a suitable glass transition temperature is selected from resins having good thermal adhesion, for example, ultraviolet absorbing resins, acrylic resins, vinyl chloride-vinyl acetate copolymer resins, epoxy resins, polyester resins, polycarbonate resins, butyral resins, polyamide resins, and vinyl chloride resins. When what is necessary is only to impart a matte tone to the image, the formation of at least one layer as the transfer layer suffices. In this case, either the transferable protective layer or the heat-sensitive adhesive layer may be adopted.

(Heat-Resistant Slip Layer)

In the protective layer thermal transfer sheet according to the present invention, a heat-resistant slip layer is preferably provided on the backside of the substrate sheet, that is, on the substrate sheet in its side remote from the transferable protective layer, from the viewpoint of avoiding adverse effects, such as sticking or cockling caused by heat from the thermal head. Any conventional resin may be used as the resin for the formation of the heat-resistant slip layer, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polyamide imide resins, polycarbonate resins, and chlorinated polyolefin resins.

A cured product produced by reacting a thermoplastic resin having therein a reaction group with a polyisocyanate, or a reaction product of the resin with an unsaturated bond-containing monomer or oligomer may be used from the viewpoint of improving the heat resistance and coating strength of the heat-resistant slip layer and the adhesion of the heat-resistant slip layer to the substrate sheet. Curing methods are not particularly limited and include heating and application of an ionizing radiation.

Slip property-imparting agents added to or coated onto the heat-resistant slip layer formed of the above resin include phosphoric esters, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred.

The heat-resistant slip layer may be formed by dissolving or dispersing the above resin, slip property-imparting agent, and filler in a suitable solvent to prepare an ink for heat-resistant slip layer formation, coating the ink onto the backside of the substrate sheet, for example, by gravure printing, screen printing, or reverse coating using a gravure plate, and drying the coating. The thickness of the heat-resistant slip layer is about 0.1 to 2 $\mu$m on a solid basis.

In the protective layer thermal transfer sheet according to the present invention, the transferable protective layer may be solely provided on the substrate sheet. Alternatively, as shown in FIG. 2, the transferable protective layer may be provided face-serially with dye layers of Y (yellow), M (magenta), C (cyan), and Bk (black) and heat-fusion ink layers of Y, M, C, and Bk. The dye layer may be formed from a suitable sublimable dye and a suitable binder resin by a conventional method. The heat-fusion ink layer may be formed from a suitable pigment and a suitable heat-fusion material, such as wax, by a conventional method.

The image-receiving sheet as an object on which an image is formed and, in addition, a protective layer is transferred from the protective layer thermal transfer sheet, is not particularly limited. For example, the substrate may be any sheet of plain papers, wood-free papers, tracing papers, plastic films and the like. The substrate may be in any form of cards, postcards, passports, letter papers, report pads, notes, catalogues and the like. The substrate may have on its surface a layer receptive to a dye, i.e., a dye-receptive layer. The receptive layer may be provided by coating or by thermal transfer, for example, using a thermal head or a hot roll. It should be noted that, when the substrate per se is receptive to a dye, there is no need to provide any receptive layer.

Further, the protective layer thermal transfer sheet according to the present invention may be used to prepare ID cards, identification cards, license cards and other cards. These cards contain information on letters in addition to information on images such as photographs. In this case, for example, a method may be used wherein information on letters is formed by a thermal ink transfer method while a photograph-like image or other image may be formed by a sublimation dye transfer method. Embosses, signatures, IC memories, magnetic layers, holograms, and other prints may also be provided on the cards. In this case, these embosses, signatures, magnetic layers and the like may be provided after the transfer of the protective layer.

In the transfer, thermal transfer printers may be provided respectively for sublimation dye transfer, thermal ink transfer, and protective layer transfer for setting separate transfer conditions. Alternatively, a common printer may be used. In this case, printing energy is properly regulated for the sublimation dye transfer, thermal ink transfer, and protective layer transfer. In the protective layer thermal transfer sheet according to the present invention, heating means for the transfer of the protective layer is not limited to the thermal transfer printer, and other means, such as hot plates, hot stampers, hot rolls, line heaters, or irons, may be used for transfer purposes. The protective layer may be transferred onto the whole area of the formed image, or alternatively may be transferred onto only a specific portion of the object.

The protective layer thermal transfer sheet for controlling the gloss of an image according to the present invention comprises the above protective layer thermal transfer sheet, the content of the filler having been controlled to a value in the range of 0.05 to 0.5% by weight to control the gloss of an image, after the transfer of the protective layer from the protective layer thermal transfer sheet to the image, to a predetermined value in the range of 0 (zero) to 50.0 as measured at an angle of incidence of 45 degrees with a glossmeter. Thus, according to the present invention, a desired gloss can be realized by regulating the content and particle diameter of the filler.

The protective layer thermal transfer sheet according to the present invention particularly preferably satisfies the following requirement (I):

$$Y=(a/(X+b))+c \quad \text{(I)}$$

wherein Y represents gloss; X represents filler content; b is $0<b\leqq 0.5$; and c is $0\leqq c\leqq 10$.

The filler content X is as described above and is 0.05 to 0.5.

The protective layer thermal transfer sheet according to the present invention further preferably simultaneously satisfies the requirement (I) and the following requirements (II) and (III):

$$0\leqq(a/(0.05+b))+c\leqq 60 \quad \text{(II)}$$

$$0\leqq(a/b)+c\leqq 100 \quad \text{(III)}$$

In the protective layer thermal transfer sheet for controlling the gloss of an image according to the present invention, the gloss was measured by the following method.

Method for measuring gloss: A print was prepared with CAMEDIA P-400, manufactured by Olympus Optical Co., Ltd., and the gloss was measured with a glossmeter VG 2000 manufactured by Nippon Denshoku Co., Ltd. at a measuring angle of 45 degrees. In this case, the printing pattern consisted of black blotted images.

EXAMPLES

The present invention will be described in more detail with reference to the following examples and comparative examples. In the following examples and comparative examples, "parts" or "%" is by weight unless otherwise specified.

Examples 1 to 8 and Comparative Examples 1 to 3

A 6 $\mu$m-thick polyethylene terephthalate film having a heat-resistant slip layer on its backside was provided. A coating liquid for a release layer having the following composition was coated at a coverage of 0.8 g/m$^2$ on a solid basis on one side of the polyethylene terephthalate film. The coating was dried at 110° C. for one min to form a release layer.

| <Coating liquid for release layer> | |
|---|---|
| Acrylic resin (CELTOP 226, manufactured by Daicel Chemical Industries, Ltd.) | 16 parts |
| Aluminum catalyst (CELTOP CAT-A, manufactured by Daicel Chemical Industries, Ltd.) | 3 parts |
| Filler indicated in Table 1 below | X parts |
| Methyl ethyl ketone | 8 parts |
| Toluene | 8 parts |

TABLE 1

| | Filler 1 | | Filler 2 | | | |
|---|---|---|---|---|---|---|
| | Type | Addition amount | Type | Addition amount | PV ratio | Remarks |
| Example 1 | SYLYSIA 320 (particle diameter 2 μm) | 2.7 | — | — | 0.33 | |
| Example 2 | SYLYSIA 320 (particle diameter 2 μm) | 4 | — | — | 0.5 | |
| Example 3 | SYLYSIA 350 (particle diameter 5 μm) | 2.7 | — | — | 0.33 | |
| Example 4 | SYLYSIA 380 (particle diameter 8 μm) | 2.7 | — | — | 0.33 | |
| Example 5 | MA 1002 (particle diameter 2 μm) | 2.7 | — | — | 0.33 | |
| Example 6 | MA 1001 (particle diameter 1 μm) | 1.35 | MA 1013 (particle diameter 13 μm) | 1.35 | 0.33 | Blend of different organic fillers |
| Example 7 | SYLYSIA 380 (particle diameter 8 μm) | 1.35 | MA 1013 (particle diameter 13 μm) | 1.35 | 0.33 | Blend of organic filler with inorganic filler |
| Example 8 | SYLYSIA 320 (particle diameter 2 μm) | 2.7 | — | — | 0.33 | |
| Comparative Example 1 | MA 1006 (particle diameter 6 μm) | 10 | — | — | 1.25 | Separation was difficult due to excessively large addition amount of filler |
| Comparative Example 2 | MA 1013 (particle diameter 13 μm) | 10 | — | — | 1.25 | Separation was difficult due to excessively large addition amount of filler |
| Comparative Example 3 | Not used | — | — | — | 0 | No filler |

SYLYSIA = silica particles, manufactured by Fuji Silysia Chemical Ltd.
MA = acrylic resin filler, manufactured by Nippon Shokubai Kagaku Kogyo Co., Ltd.

Further, in Examples 1 to 8 and Comparative Examples 1 and 2, a coating liquid for a protective layer having the following composition was coated by wire bar coating at a coverage of 1.0 g/m$^2$ on a solid basis onto the surface of the release layer. The coating was dried in an oven at 110° C. for one min to form a protective layer. In Comparative Example 3, the coating liquid for a protective layer was coated directly onto the surface of the substrate film in the same manner as described just above, and the coating was dried.

| <Coating liquid for protective layer> | |
|---|---|
| Acrylic resin (Dianal BR 87, manufactured by Mitsubishi Rayon Co., Ltd.) | 20 parts |
| Methyl ethyl ketone | 40 parts |
| Toluene | 40 parts |

Further, in Examples 1 to 7 and Comparative Examples 1 and 3, a coating liquid for an adhesive layer having the following composition was coated by wire bar coating at a coverage of 1.0 g/m$^2$ on a solid basis onto the surface of the protective layer. The coating was dried in an oven at 110° C. for one min to form an adhesive layer. Thus, protective layer thermal transfer sheets of the present invention and comparative protective layer thermal transfer sheets were prepared. In Example 8, no adhesive layer was formed, and the assembly without the adhesive layer as such was provided as the protective layer thermal transfer sheet.

| <Coating liquid for adhesive layer> | |
|---|---|
| Polyester resin (Vylon 240, manufactured by Toyobo Co., Ltd.) | 20 parts |
| Methyl ethyl ketone | 40 parts |
| Toluene | 40 parts |

APPLICATION EXAMPLE

A white vinyl chloride sheet having a sublimation dye transferred image on its surface was provided. The protective layer in each of the protective layer thermal transfer sheets of Examples 1 to 8 and Comparative Examples 1 to 3 was transferred by means of a laminator onto the surface of the image. For the protective layer transferred image, the gloss and matte tone of the image and the peel force of the protective layer from the substrate film were examined by the following methods. The results are shown in Table 2 below.

Measurement of Gloss:

Measured with Gloss Meter VG 2000, manufactured by Nippon Denshoku Co., Ltd. at an angle of incidence of 45 degrees.

Matte Tone:

Examined by visual inspection. The results were evaluated according to the following criteria.

○: Favorable matte tone

Δ: Lowered gloss and matte tone, but unsatisfactory matte feeling

X: Glossy tone.

Measurement of Peel Force:

The protective layer thermal transfer sheet was put on top of the white vinyl chloride sheet having a sublimation dye transferred image so that the surface of the adhesive layer in each of the protective layer thermal transfer sheets of Examples 1 to 7 and Comparative Examples 1 to 3 (the surface of the protective layer for Example 8) was brought into contact with the surface of the image in the white vinyl chloride sheet, followed by lamination by means of a laminator (LAMIPACKER LPD 2305 PRO, manufactured by FUJIPLA Inc.) under conditions of 110° C. and 1 m/min. The substrate film in the protective layer thermal transfer sheet was separated from the laminate. In other words, the protective layer was separated from the substrate film. At that time, the force necessary for the separation was determined. The results were evaluated according to the following criteria.

Incidentally, in the protective layer thermal transfer sheets used, drying conditions at the time of the formation of the release layer were 110° C.×1 min.

◎: The protective layer could be easily separated.

○: The protective layer could be separated.

X: The protective layer could not be separated without difficulty, and a part of the protective layer thermal transfer sheet was broken.

TABLE 2

| | Gloss | Matte tone | Peel force | Remarks |
|---|---|---|---|---|
| Example 1 | 20 | Δ | ○ | |
| Example 2 | 20.2 | Δ | ○ | |
| Example 3 | 23.4 | ○ | ○ | |
| Example 4 | 30.1 | ○ | ○ | |
| Example 5 | 27.5 | Δ | Δ | |
| Example 6 | 31.1 | ○ | Δ | Blend of different organic fillers |
| Example 7 | 28 | ○ | ○ | Blend of organic filler with inorganic filler |
| Example 8 | 20 | Δ | ○ | |
| Comparative Example 1 | 30 | ○ | X | Separation was difficult due to excessively large addition amount of filler |
| Comparative Example 2 | 31.2 | ○ | X | Separation was difficult due to excessively large addition amount of filler |
| Comparative Example 3 | 75.5 | X | ◎ | No filler |

As is apparent from the foregoing description, the present invention can provide a protective layer thermal transfer sheet which can impart an excellent matte tone to an image, produced by a sublimation dye thermal transfer method, without the need to additionally provide any special step and without deteriorating high definition and high sharpness of images inherent in sublimation dye transferred images.

What is claimed is:

1. A protective layer thermal transfer sheet, comprising:

a substrate sheet;

a release layer provided on at least a part of one side of the substrate sheet;

a protective layer provided on the release layer; and an optional adhesive layer provided on the protective layer;

wherein:

the release layer contains a resin and a filler;

the release layer has a roughened surface;

the filler is present in the release layer at a PV ratio of from 0.05 to 0.5% by weight so as to provide an image with a gloss of from 0 to 50.0 when the protective layer is transferred from the protective layer thermal transfer sheet onto the image;

the PV ratio is a ratio of a solid content of the filler in the release layer to a solid content of a binder in the release layer; and the gloss is measured at an angle of incidence of 45 degrees with a glossmeter.

2. The protective layer thermal transfer sheet according to claim 1, wherein the filler has an average particle diameter of 1 to 20 $\mu$m.

3. A matted print, comprising:

a sublimation dye transferred image; and a protective layer provided on a surface of the image;

wherein fine concaves and convexes are transferred onto a surface of the protective layer using the protective layer thermal transfer sheet according to claim 1.

* * * * *